US009242154B2

(12) United States Patent
Knutson

(10) Patent No.: US 9,242,154 B2
(45) Date of Patent: Jan. 26, 2016

(54) CLUB LENGTH ADJUSTMENT DEVICE

(71) Applicant: Acushnet Company, Fairhaven, MA (US)

(72) Inventor: Scott A. Knutson, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 92 days.

(21) Appl. No.: 14/069,665

(22) Filed: Nov. 1, 2013

(65) Prior Publication Data

US 2015/0126298 A1 May 7, 2015

(51) Int. Cl.

*A63B 53/16* (2006.01)
*A63B 59/00* (2015.01)
*A63B 53/10* (2015.01)

(52) U.S. Cl.

CPC ..... *A63B 59/0074* (2013.01); *A63B 53/10* (2013.01); *A63B 53/16* (2013.01); *A63B 2059/0085* (2013.01)

(58) Field of Classification Search

CPC .... A63B 59/0074; A63B 53/10; A63B 53/16; A63B 2059/0085

See application file for complete search history.

(56) References Cited

U.S. PATENT DOCUMENTS

| | | | |
|---|---|---|---|
| 1,557,156 | A | 10/1925 | Gless |
| 1,569,765 | A | 1/1926 | Lowell |
| 1,613,360 | A | 1/1927 | Rigby |
| 1,634,082 | A | 6/1927 | Rigby |
| 1,634,887 | A | 7/1927 | Rigby |
| 1,648,806 | A | 11/1927 | Hadden |
| 1,650,183 | A | 11/1927 | Brooks |
| 1,665,811 | A | 4/1928 | Hadden |
| 1,704,544 | A | 3/1929 | Novak |
| 1,943,066 | A | 1/1934 | Ford |
| 2,027,452 | A | 1/1936 | Rusing |
| 2,107,983 | A | 2/1938 | Hamilton |
| 2,214,079 | A | 9/1940 | Horn |
| 2,475,927 | A | 5/1945 | Verderber |
| 2,446,622 | A | 8/1948 | Turner |
| 2,468,202 | A | 4/1949 | Karns |
| D160,396 | S | 10/1950 | Karns |
| 2,604,660 | A | 7/1952 | Karns |
| 2,604,661 | A | 7/1952 | Karns |
| 2,704,668 | A | 3/1955 | Park |
| 2,879,065 | A | 3/1959 | Smith |
| 3,102,726 | A | 9/1963 | Barrett |
| 3,516,697 | A | 6/1970 | Hahn |
| 3,524,646 | A | 8/1970 | Wheeler |

(Continued)

FOREIGN PATENT DOCUMENTS

| | | |
|---|---|---|
| GB | 2309389 | 7/1997 |

*Primary Examiner* — Stephen Blau
(74) *Attorney, Agent, or Firm* — Kevin N. McCoy

(57) ABSTRACT

A golf club length adjustment device for use in a golf club, comprising a first member affixed to a main shaft, said main shaft configured to couple to a golf club head, a second member slideably coupled to said first member, said second member adapted to couple to a golf club grip, said golf club grip including an internal cavity configured to receive a golf club shaft, wherein said first member is configured to slide relative to said second member to change the length of said golf club, wherein said first member and said second member are configured to limit rotation of said first member relative to said second member, a locking system configured to selectively limit said first member from sliding relative to said second member, wherein said locking system comprises a locked position and an unlocked position.

13 Claims, 7 Drawing Sheets

(56) References Cited

U.S. PATENT DOCUMENTS

| | | | | | |
|---|---|---|---|---|---|
| 3,539,185 | A | * | 11/1970 | Andis | 473/296 |
| 4,669,726 | A | | 6/1987 | Lempio | |
| 4,826,168 | A | | 5/1989 | McGuire et al. | |
| 4,852,782 | A | * | 8/1989 | Wu et al. | 224/661 |
| 5,024,438 | A | | 6/1991 | Candow | |
| 5,083,779 | A | | 1/1992 | Ungermann | |
| 5,294,117 | A | | 3/1994 | Huang | |
| 5,385,346 | A | | 1/1995 | Carroll et al. | |
| 5,390,921 | A | | 2/1995 | De Ruyter | |
| 5,452,891 | A | | 9/1995 | Thomas | |
| 5,496,029 | A | | 3/1996 | Heath et al. | |
| 5,569,096 | A | | 10/1996 | Lee | |
| 5,584,096 | A | | 12/1996 | Aurora | |
| 5,626,527 | A | | 5/1997 | Eberlein | |
| 5,649,870 | A | | 7/1997 | Harrison | |
| 5,924,937 | A | | 7/1999 | Kuo | |
| 6,196,930 | B1 | | 3/2001 | Aumock | |
| 6,413,168 | B1 | | 7/2002 | McKendry et al. | |
| 6,511,386 | B1 | | 1/2003 | Cacicedo | |
| 6,547,673 | B2 | | 4/2003 | Roark | |
| 6,623,372 | B1 | | 9/2003 | Beebe et al. | |
| 6,780,120 | B2 | * | 8/2004 | Murray | 473/239 |
| 6,875,123 | B2 | | 4/2005 | Wilson | |
| 7,018,302 | B2 | | 3/2006 | Jacoby | |
| 7,159,451 | B2 | | 1/2007 | McGann et al. | |
| 7,250,005 | B2 | | 7/2007 | Wood et al. | |
| 7,261,641 | B2 | | 8/2007 | Lindner | |
| 7,316,622 | B1 | | 1/2008 | Lucas | |
| 7,611,422 | B2 | | 11/2009 | Hocknell et al. | |
| 7,699,718 | B2 | | 4/2010 | Lindner | |
| 7,704,161 | B2 | | 4/2010 | Lindner | |
| D622,341 | S | | 8/2010 | Pepin | |
| 8,348,783 | B2 | | 1/2013 | Soracco et al. | |
| 8,491,408 | B2 | * | 7/2013 | Beach et al. | 473/296 |
| 8,529,367 | B2 | | 9/2013 | Evans et al. | |
| 8,568,246 | B2 | | 10/2013 | Wall et al. | |
| 8,678,944 | B2 | * | 3/2014 | Wall, Jr. | 473/296 |
| 2002/0091012 | A1 | | 7/2002 | Evans | |
| 2003/0083144 | A1 | * | 5/2003 | Shin | 473/296 |
| 2003/0148819 | A1 | | 8/2003 | Lindner | |
| 2005/0143186 | A1 | | 6/2005 | Blattner et al. | |
| 2009/0270197 | A1 | | 10/2009 | Holtzman | |
| 2012/0142444 | A1 | * | 6/2012 | Chol | 473/296 |
| 2013/0281224 | A1 | * | 10/2013 | Zabala Scharpp | 473/288 |

* cited by examiner

CLUB LENGTH ADJUSTMENT DEVICE

TECHNICAL FIELD

The present technology generally relates to systems, devices, and methods related to golf clubs, and more specifically to adjustable length golf clubs.

DESCRIPTION OF THE RELATED TECHNOLOGY

One of the more important factors in golf club equipment is the club shaft. The shaft transfers the golfer's power to the club head. Golf club shafts are available in various types of materials and structures. Steel shafts can be stronger, last longer, more durable and generally less expensive than graphite or carbon fiber shafts, and are usually made from carbon steel, although stainless steel is sometimes used. The steel shafts are available in stepped or rifle designs. The graphite shafts can be more expensive and less durable; however, the lighter weight creates greater swing speed for more power. Also available are multi-material and titanium shafts.

When installing a shaft, the proper length must be accurately determined. The length can be as important to a golf shaft as is the flex or torque. Most measurements of the correct shaft length for the player involve a determination of a particular player's height and distance of his hands to the floor. Shaft length will impact whereon the clubface the ball will be consistently struck, and often, an incorrect shaft length is the main cause of a golfer to alter his natural swing arc in order to make optimum impact. According to most research, if ball impact is but one inch off-center this can equate to a 14% loss of carry distance, so it is vitally important that the length of the club be accurately fitted for each particular player.

If it is seen in the fitting process that a player needs to adjust his club length, such as adding or removing a half inch, inch or two inches to the length of the club, it would be highly desirable to lengthen his present club(s) rather buy and install new shafts. Typical driver shaft lengths are from 43 to 47 inches.

Prior art shafts having adjustable lengths have been used for many years for a wide variety of applications. Each of these applications has its own functional and aesthetic requirements for the shaft construction which is employed. As a consequence, a number of different mechanisms and devices have been developed to satisfy the particular application requirements. A majority of golf club shaft extension patents are directed to use mainly as putters, or to extending shafts of an existing set of clubs to accommodate growing children.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that existing golf club designs do not provide a convenient and hidden shaft length adjustment system. Thus, there exists a need for a rigid, secure, and easily adjustable club length adjustment system, which is hidden from view and does not require a custom grip. The present technology is directed to a golf club length adjustment device. The club length adjustment device provides the ability for a golfer to adjust the length of a golf club to suit their preference.

One non-limiting embodiment of the present technology includes a golf club length adjustment device for use in a golf club, comprising a first member affixed to a main shaft, said main shaft configured to couple to a golf club head; a second member slideably coupled to said first member, said second member adapted to couple to a golf club grip, said golf club grip including an internal cavity configured to receive a golf club shaft; wherein said first member is configured to slide relative to said second member to change the length of said golf club; wherein said first member and said second member are configured to limit rotation of said first member relative to said second member; a locking system configured to selectively limit said first member from sliding relative to said second member; wherein said locking system comprises a locked position and an unlocked position; wherein said locking system is configured to selectively lock said first member relative to said second member at each of a plurality of discrete golf club lengths; wherein said locking system comprises at least one locking member and a plurality of detents, wherein said locking member is configured to selectively engage at least one of said plurality of detents; wherein said locking system is hidden from view inside said golf club.

Another non-limiting embodiment includes a golf club length adjustment device, wherein at least a portion of said at least one locking member is deflectable and, wherein said at least one locking member, when in said unlocked position, is configured to partially engage at least one of said plurality of detents at each of said discrete golf club lengths creating a click.

Another non-limiting embodiment includes a golf club length adjustment device, wherein said at least one locking member, when in said locked position, is configured to fully engage at least one of said plurality of detents and limit said first member from sliding relative to said second member.

Another non-limiting embodiment includes a golf club length adjustment device, wherein said at least one locking member comprises a protrusion configured to engage at least one of said plurality of detents, wherein said protrusion comprises a partial sphere shape.

Another non-limiting embodiment includes a golf club length adjustment device comprising an actuating member configured to force said at least one locking member into said locked position, wherein said actuating member comprises a tool receiving portion such that a user can adjust said actuating member.

Another non-limiting embodiment includes a golf club length adjustment device, wherein rotation of said actuating member forces said at least one locking member into said locked position.

Another non-limiting embodiment includes a golf club length adjustment device, wherein said plurality of detents are formed in said second member.

Another non-limiting embodiment includes a golf club length adjustment device, wherein said at least one locking member is formed integrally in said first member, wherein said first member comprises an actuating bore comprising an internal thread, wherein said actuating bore is configured to receive said actuating member, wherein said actuating member comprises a complimentary external thread, wherein said actuating member is configured to translate through said actuating bore via rotation of said actuating member.

Another non-limiting embodiment includes a golf club length adjustment device, wherein said actuating member comprises at least one tapered portion configured to engage said at least one locking member and force said locking member into said locked position.

Another non-limiting embodiment includes a golf club length adjustment device, wherein said tool receiving portion of said actuating member is configured to receive a tool inserted through an access hole formed in a proximal portion of said golf club grip, wherein said golf club grip comprises a standard commercially available golf club grip.

Another non-limiting embodiment includes a golf club length adjustment device comprising a length indication system comprising a plurality of marking indicia on said main shaft configured to indicate said length of said golf club.

Another non-limiting embodiment includes a golf club length adjustment device, wherein said first member comprises a first spline and said second member comprises a complimentary second spline, said first spline and said second spline configured to limit rotation of said first member relative to said second member.

Another non-limiting embodiment includes a golf club length adjustment device, wherein said first spline and said second spline comprise complementary clocking features configured to prevent said first member and said second member from being assembled at an incorrect relative angular orientation.

Another non-limiting embodiment includes a golf club length adjustment device, wherein said clocking features comprise at least one enlarged spline recess and at least one enlarged spline protrusion.

Another non-limiting embodiment includes a golf club length adjustment device comprising a backout prevention member configured to limit said first member from uncoupling from said second member after said golf club length adjustment device has been assembled.

Another non-limiting embodiment includes a golf club length adjustment device, wherein said second member comprises a receiving bore, wherein said second member is configured to receive at least a portion of said first member within said receiving bore of said second member.

Another non-limiting embodiment includes a golf club length adjustment device, wherein said club length adjustment device further comprises a hollow receiving shaft having an interior and an exterior, wherein said second member is affixed to said interior of said receiving shaft, wherein said exterior of said receiving shaft is configured to couple to said golf club grip, wherein said interior of said receiving shaft is configured to slideably receive a portion of said main shaft.

Another non-limiting embodiment includes a golf club length adjustment device for use in a golf club, comprising a first member affixed to a main shaft, said main shaft configured to couple to a golf club head; a second member slideably coupled to said first member, said second member adapted to couple to a golf club grip, said golf club grip including an internal cavity configured to receive a golf club shaft; wherein said first member is configured to slide relative to said second member to change the length of said golf club; wherein said first member and said second member are configured to limit rotation of said first member relative to said second member; a locking system configured to selectively limit said first member from sliding relative to said second member; wherein said locking system comprises a locked position and an unlocked position; wherein said locking system is configured to selectively lock said first member relative to said second member at each of a plurality of discrete golf club lengths; wherein said locking system is hidden from view inside said golf club; wherein said locking system is configured receive a tool inserted through an access hole formed in a proximal portion of said golf club grip, wherein rotation of said tool selectively locks and unlocks said locking system, wherein said golf club grip comprises a standard commercially available golf club grip.

Another non-limiting embodiment includes a method for adjusting the length of a golf club, comprising inserting a tool through an access hole formed in a proximal portion of a golf club grip; rotating said tool in a first direction to unlock a golf club length adjustment device hidden from view; sliding a main shaft of said golf club relative to said golf club grip towards one of a plurality of discrete golf club lengths, wherein said main shaft is configured to couple to a golf club head, wherein sliding of said main shaft relative to said golf club grip is at least partially inhibited when said golf club reaches each of said plurality of discrete golf club lengths; rotating said tool in a second direction, opposite said first direction, to lock said golf club length adjustment device once said golf club has reached said one of a plurality of discrete golf club lengths.

Another non-limiting embodiment of a method for adjusting the length of a golf club includes sliding a main shaft of said golf club relative to said golf club grip further comprises utilizing marking indicia on said main shaft of said golf club to reach a desired golf club length.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
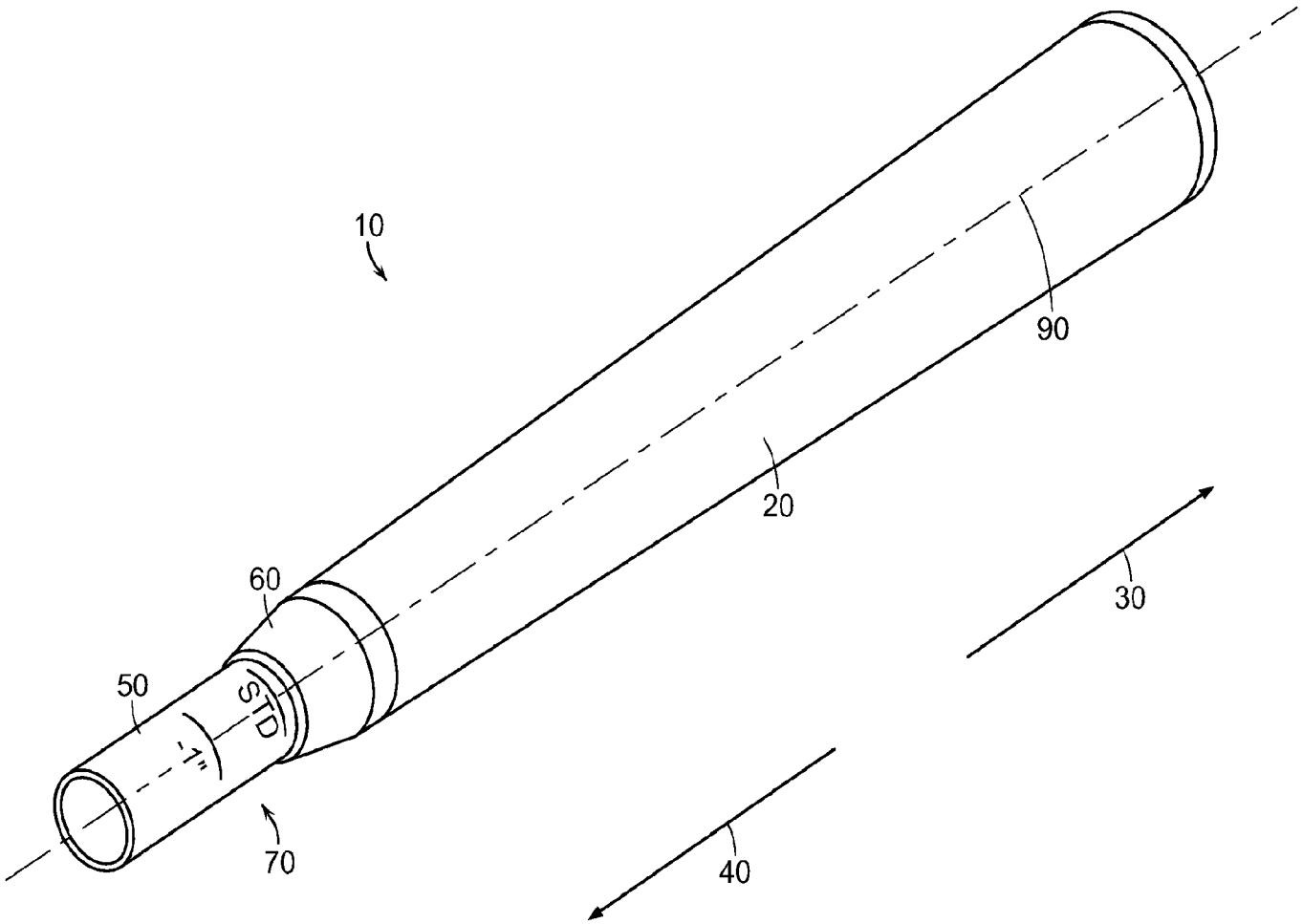
FIG. 1 illustrates a perspective view of one embodiment of a club length adjustment device coupled to a grip.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to systems, devices, and methods related to golf clubs. More specifically, some embodiments relate to a golf club length adjustment device 10.

FIG. 1 illustrates a perspective view of one embodiment of a club length adjustment device 10 coupled to a grip 20. In some embodiments, a golf club can include a club length adjustment device 10. The club length adjustment device 10 can be at least partially hidden from view once the club has been assembled, advantageously allowing the golf club to appear just like a standard non-adjustable golf club. In some embodiments, the device can be completely hidden from view. As illustrated in FIGS. 1 and 2, the club length adjustment device 10 can be located at a proximal 30 portion of the golf club. "Proximal," when used herein, is used to describe a portion of the golf club closer to the golfer when in use and "distal" is used to describe a portion of the golf club further from the golfer. The head of the golf club utilized to strike the ball, which is not illustrated, is located at the distal 40 end of the golf club, and more specifically at the distal 40 end of the main shaft 50 which has been abbreviated for clarity in FIGS. 1 and 2. The golf club head can be coupled to the distal 40 end of the main shaft 50 through a variety of techniques.

The length of the golf club, which is measured along the club axis 90 (illustrated in FIG. 1), can be adjusted by sliding the main shaft 50 either towards or away from the grip 20. In some embodiments, the club length adjustment device 10 can include a ferrule 60 located at the distal 40 end of the grip 20. The ferrule 60 can serve a variety of purposes. The ferrule 60 can add to the strength of the club length adjustment device 10, increasing rigidity and providing a solid feel for the golfer. The ferrule 60 can also aid in hiding portions of the club length adjustment device 10 from view. In some embodiments, the club length adjustment device 10 can include a club length indication system, indicating to the user the present length of the club. The main shaft 50 can include marking indicia 70, as illustrated in FIG. 1, which when referenced against another part of the golf club, which may include the ferrule 60 for example, can help the user achieve the desired club length when adjusting the club length adjustment device 10. In other embodiments, a different portion of the club such as the receiving shaft 80 or grip 20 can be used as a reference point. In some embodiments, the marking indicia 70 can include relative lengths which may include, for example, +2", +1.5", +1", +0.5", STD, −0.5", −1", −1.5", −2". Smaller or larger increments and/or smaller or larger ranges of adjustment can be included as well. Marking indicia 70 can be produced with paint, etching, laser marking, stickers, etc.

While the club length adjustment device 10 can be adjusted and manipulated by a golfer, it is also within the scope of this disclosure that the device can be manipulated by a technician assembling the club or a fitting expert modifying the club for the golfer. For purposes of this disclosure, golfers, technicians, fitting experts, etc., are referred to herein as users.

Figure 2A:
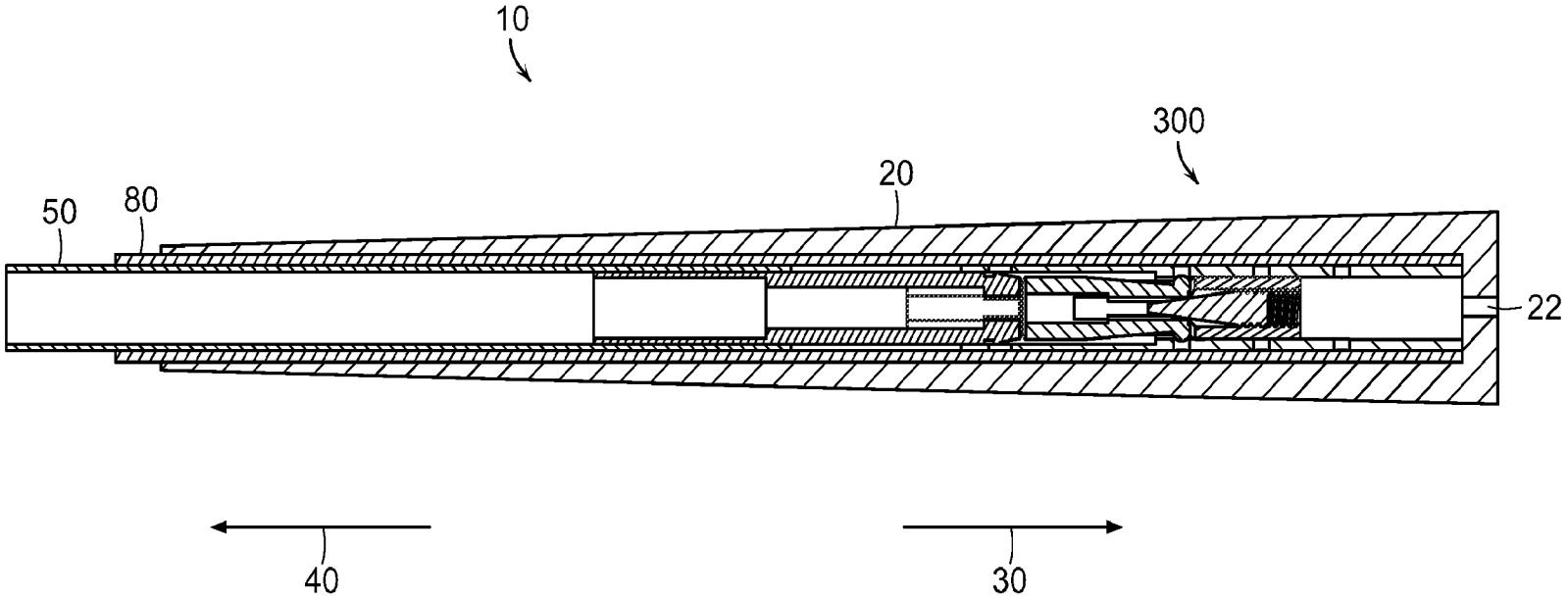
FIG. 2A illustrates a cross section view of the club length adjustment device of FIG. 1 coupled to a grip.
Figure 2B:
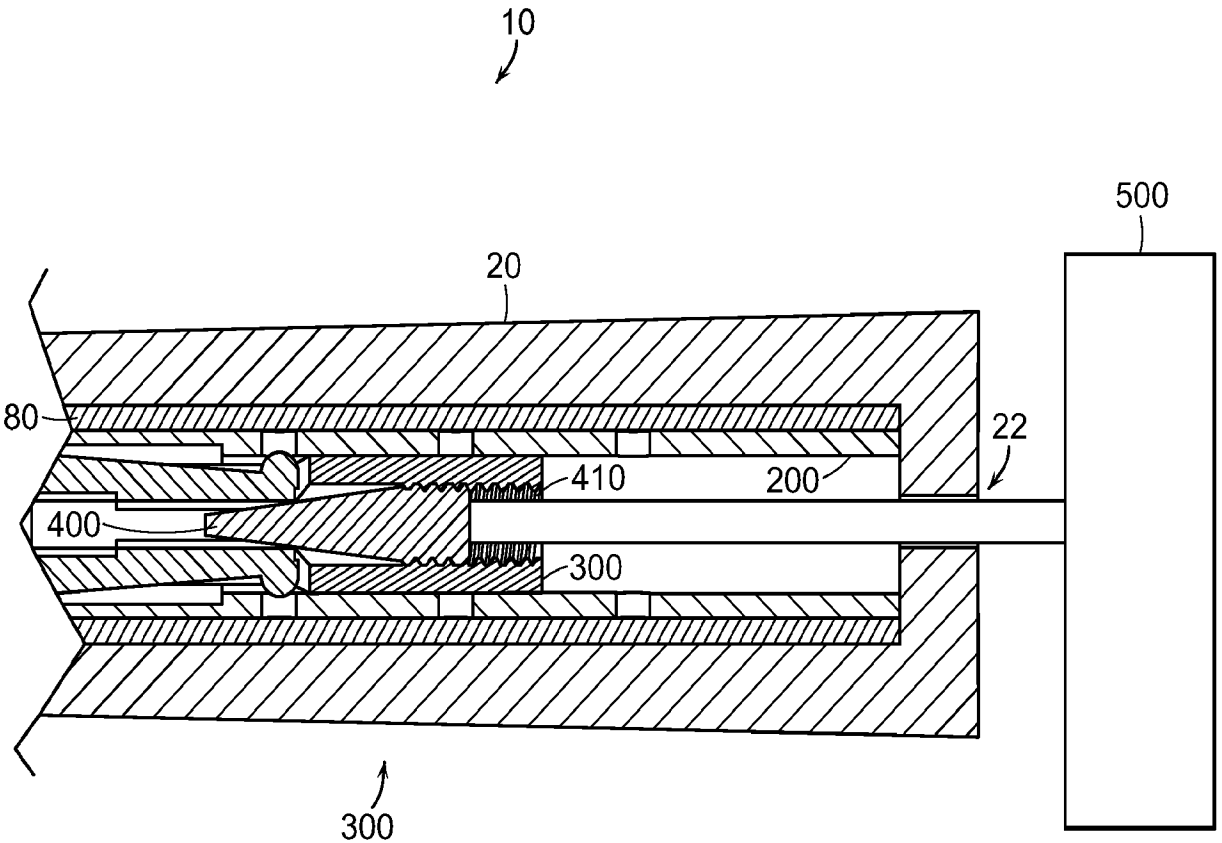
FIG. 2B illustrates a cross section view of a portion of the club length adjustment device of FIG. 1 coupled to a grip.

FIG. 2A illustrates a cross section view of the club length adjustment device 10 of FIG. 1 coupled to a grip 20. FIG. 2B illustrates a cross section view of a portion of the club length adjustment device of FIG. 1 coupled to a grip. In some embodiments, the club length adjustment device 10 can include a first member 100 and a second member 200. The first member 100 can be affixed to a proximal 30 portion of a main shaft 50. In some embodiments, the main shaft 50, which is hollow, can receive at least a portion of the first member 100 within its interior. The exterior surface of the first member 100 can be affixed to the interior surface of the main shaft 50. Affixing the first member 100 to the main shaft 50 can include, for example, bonding, welding, interference fitting, etc. A distal 40 portion of the main shaft 50, the end opposite the first member 100, can be coupled to a golf club head.

The second member 200 can be coupled to the grip 20. In some embodiments, the club length adjustment device 10 can couple to a standard commercially available golf club grip 20, minimizing costs. The club length adjustment device 10 can comprises a hollow receiving shaft 80 having an interior and an exterior. The second member 200 can be affixed within the interior of the receiving shaft 80 and the exterior of the receiving shaft 80 can be dimensioned to receive the grip 20. In some embodiments, the second member 200 can be affixed to a proximal 30 portion of the receiving shaft 80. The exterior of the receiving shaft 80 can be configured to receive tape on an exterior surface, just like a standard shaft, before the grip 20 is installed, aiding in coupling the grip 20 to the club length adjustment device 10 and allowing the diameter of the grip 20 to be customized to a golfer's preference.

In some embodiments, the receiving shaft 80 can be dimensioned to be substantially the same length as a standard golf grip 20. In other embodiments, and as illustrated in FIG. 2A, the receiving shaft 80 can extend distally beyond the distal 40 end of the grip 20 once installed in the grip 20. In such embodiments, as illustrated in FIG. 1, a ferrule 60 can be affixed to the exterior of the distal 40 end of the receiving shaft 80. In some embodiments, in order to further strengthen the distal 40 end of the receiving shaft 80, the receiving shaft 80 can include a reinforcing ring bonded to the end of the receiving shaft 80. The reinforcing ring can increase the hoop strength at the end of the receiving shaft 80, helping to reduce the chances of failure due to the bending moment caused by each swing of the club. The reinforcing ring can comprise a contrasting color to the main shaft 50, aiding in reading the marking indicia 70. In some embodiments, the reinforcing ring can be composed of titanium.

In some embodiments, the first member 100 can be slideably coupled to the second member 200 such that the first member 100 can slide relative to the second member 200 to change the length of the golf club and thus change the distance between the grip 20 and the golf club head. The receiving shaft 80 can be dimensioned to slideably receive a proximal 30 portion of the main shaft 50 and the first member 100. In some embodiments, the main shaft 50 can slide within a distal 40 portion of the receiving shaft 80. The second member 200 can include a receiving bore 210 dimensioned to receive at least a portion of the first member 100.

In some embodiments, the club length adjustment system can include a locking system 300. The locking system 300 can selectively limit the first member 100 from sliding relative to the second member 200, and thus the main shaft 50 relative to the grip 20. The locking system 300 can include a locked position and an unlocked position. The club length adjustment system can include an actuating member 400. The actuating member 400 can force the locking system 300 from an unlocked position to a locked position. The actuating member 400 can include a tool receiving portion. The tool receiving portion can be located at the proximal 30 end of the actuating member 400. The grip 20, as is the case with most standard grips, can include an access hole 22 at the proximal 30 end. As illustrated in FIG. 2B, a tool 500 can be inserted through the access hole 22 to engage the tool receiving portion of the actuating member 400 to manipulate the actuating member 400 and to lock or unlock the locking system 300. In some embodiments, the actuating member 400 can be hidden from view once the club length adjustment device 10 is assembled. In some embodiments, the length of a golf club including the club length adjustment device can be adjusted without the addition or removal of any spacers or additional materials. In some embodiments, the only elements, in addition to the club itself, necessary to adjust the length of the club is a tool and the hands of the user.

Figure 3:
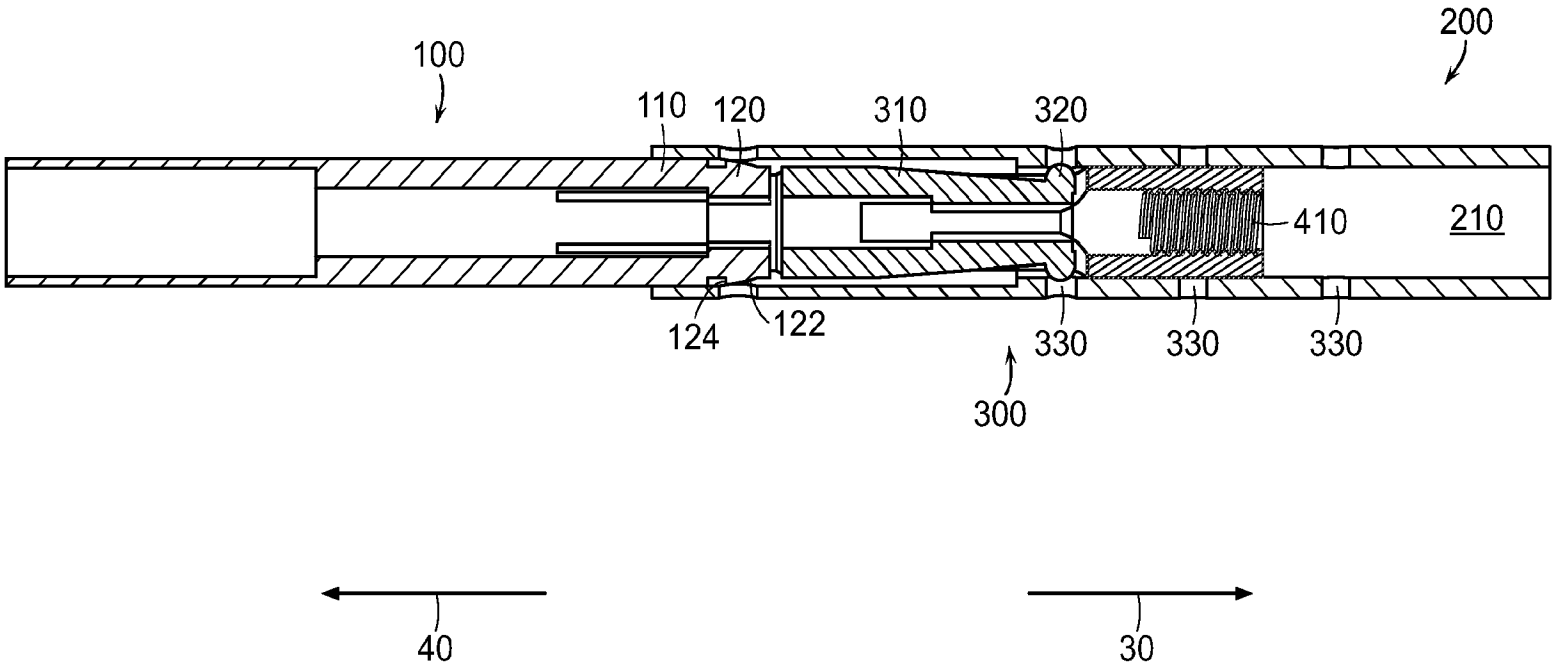
FIG. 3 illustrates a cross section view of the club length adjustment device of FIG. 1.
Figure 4A:
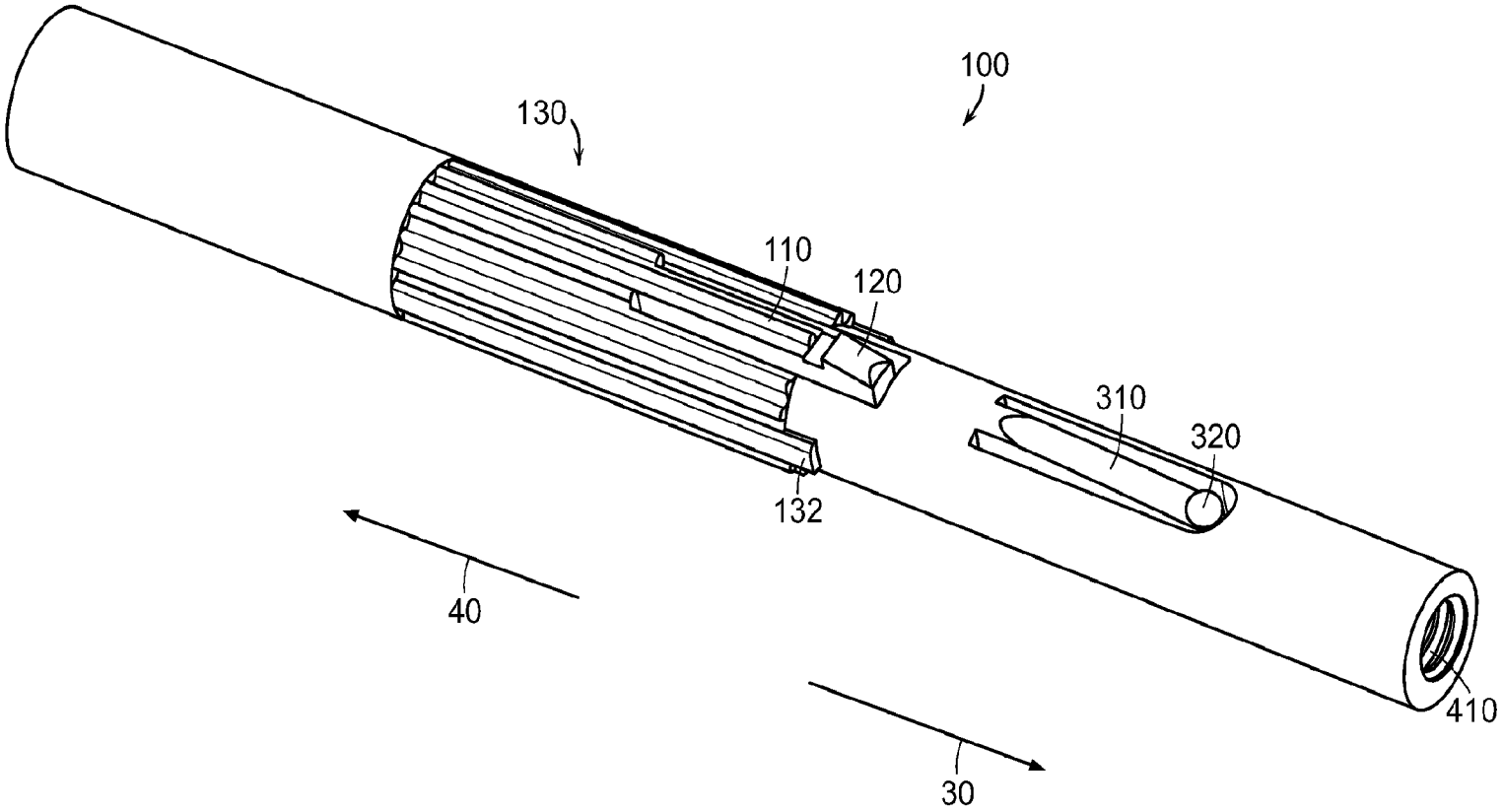
FIG. 4A illustrates a perspective view of one embodiment of a first member of the club length adjustment device.
Figure 4B:
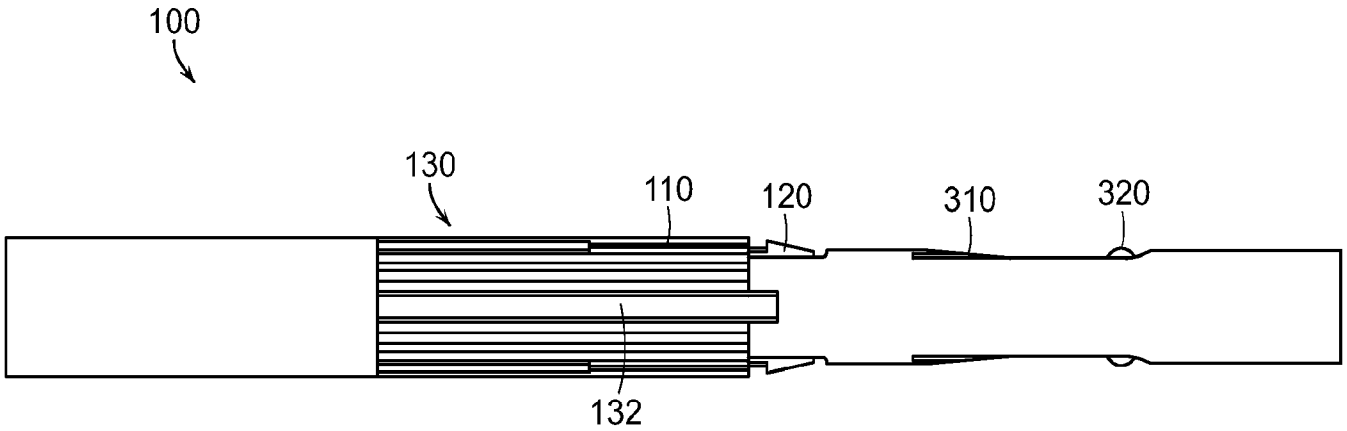
FIG. 4B illustrates a side view of the first member of FIG. 4A.
Figure 4C:
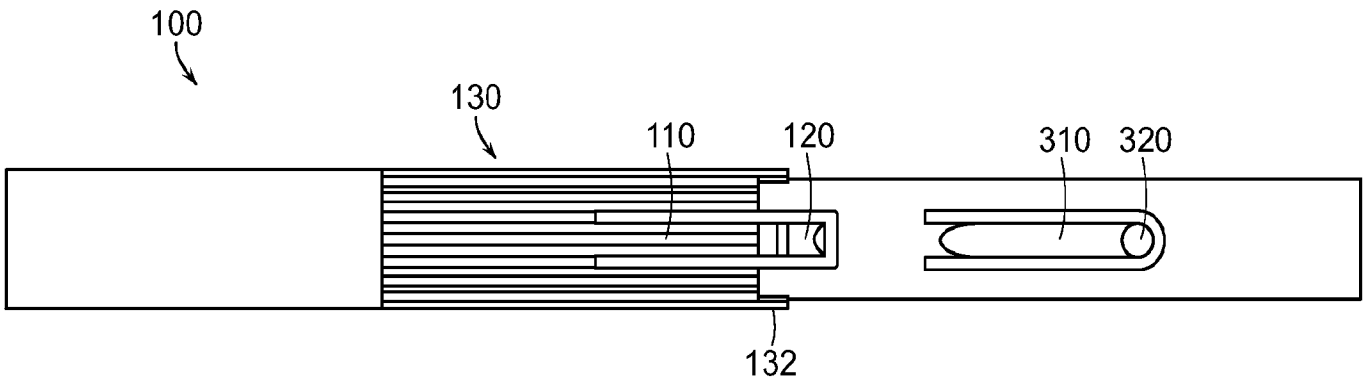
FIG. 4C illustrates an additional side view, rotated 90 degrees relative to FIG. 4B, of the first member of FIG. 4A.
Figure 5:
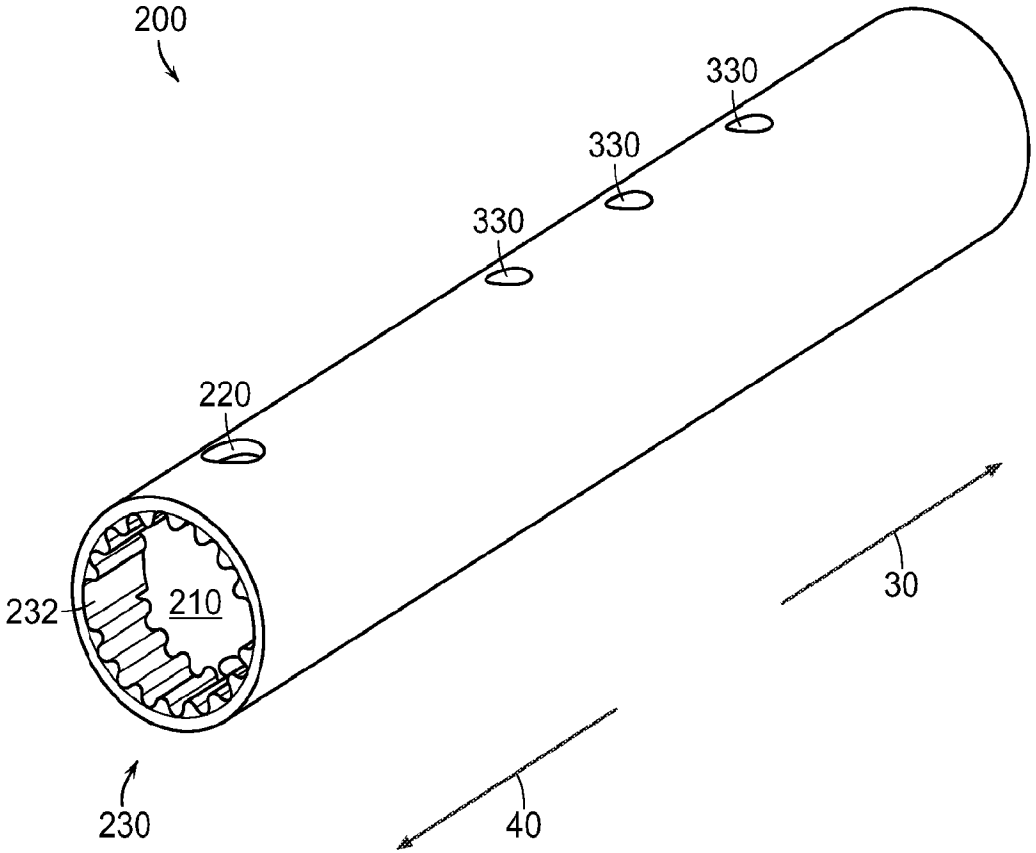
FIG. 5 illustrates a perspective view of one embodiment of a second member of the club length adjustment device.

FIG. 3 illustrates a cross section view of the club length adjustment device 10 of FIG. 1. FIG. 3 does not illustrate the main shaft 50, grip 20, or receiving shaft 80. FIG. 4A illustrates a perspective view of one embodiment of a first member 100 of the club length adjustment device 10. FIG. 4B illustrates a side view of the first member 100 of FIG. 4A. FIG. 4C illustrates an additional side view, rotated 90 degrees relative to FIG. 4B, of the first member 100 of FIG. 4A. FIG. 5 illustrates a perspective view of one embodiment of a second member 200 of the club length adjustment device 10.

In some embodiments, the locking system 300 can selectively lock the first member 100 relative to the second member 200 at each of a plurality of discrete golf club lengths. Discrete golf club lengths can be advantageous, allowing a user to replicate or choose a desired golf club length quickly and easily. In some embodiments, as illustrated in FIGS. 3 and 5, the locking system 300 can include a plurality of detents 330 formed in the second member 200. The detents 330 can comprise apertures formed through the sidewall of the second member 200. In other embodiments, the detents 330 can comprise indentations or cavities formed in the second member 200. The detents 330 can be dimensioned to receive the locking member 310 and limit the first member 100 from sliding relative to the second member 200. The plurality of detents 330 can be spaced down the length of the second member 200, providing a plurality of discrete points at which to lock the locking system 300 and thus set the length of the golf club. In some embodiments, as illustrated in FIG. 3, the second member 200 can include a plurality of detents 330 at each discrete club length, allowing for multiple locking members 310 to engage multiple detents 330 at each discrete club length.

In some embodiments, the locking system 300 can include at least one locking member 310 moveably attached to the first member 100. The locking member 310 can be adapted to engage the detents 330 of the second member 200 and limit movement between the first member 100 and second member 200. In some embodiments, as illustrated in FIGS. 3, 4A, and 4B, the at least one locking member 310 can be formed integrally in the first member 100. The locking member 310 can include a protrusion 320 dimensioned to engage at least one of the plurality of detents 330 in the second member 200. In some embodiments, the protrusion 320 can be partial sphere shaped. In other embodiments, the protrusion 320 may include other shapes. In some embodiments, at least a portion of the locking member 310 can be deflectable. The locking member 310 can deflect from an unlocked position to a locked position. In some embodiments, the default position of the locking member 310 is an unlocked position. The locking member 310 can be dimensioned such that in an unlocked position, the locking member 310 will partially engage at least one of the plurality of detents 330 at each of the discrete golf club lengths. When the locking member 310 partially engages a detent 330, the protrusion 320 extends partially into the detent 330, offering some resistance to moving the first member 100 relative to the second member 200, but not locking the first member 100 relative to the second member 200. In addition, when the locking member 310 reaches a detent 330 at each of the discrete golf club lengths, the locking member 310 partially engaging the detent 330 can produce a click. In some embodiments, the click can be audible to the user, indicating that they have reached a discrete golf club length. In some embodiments, the click can produce resistance to movement, offering a tactile feel for the user indicating that they have reached a discrete golf club length. In some embodiments, the click can be both audible and tactile. Once the user has reached a discrete golf club length and confirmed that the particular length is the preferred length, they can lock the locking system 300, moving the locking member 310 into a locked position, wherein the locking member 310 fully engages the detent 330, and the protrusion 320 is fully seated within the detent 330, limiting movement between the first member 100 and second member 200, and locking the club at the desired club length. In some embodiments, the locking member 310 can be hidden from view once the club length adjustment device 10 is assembled.

As illustrated in FIG. 3, the first member 100 can include an actuating bore 410 dimensioned to receive an actuating member 400. The actuating bore 410 can include an internal thread. The actuating member 400, illustrated in FIGS. 2A and 2B, can include a complementary external thread, such that rotation of the actuating member 400 within the actuating bore 410 causes the actuating member 400 to translate along the club axis 90. The actuating member 400, along with the first and second member 200, can be hidden from view underneath the grip 20, yet still be manipulated by the user via a tool 500 as illustrated in FIG. 2B. As described above the tool 500 can be inserted through the access hole 22 in the proximal 30 end of the grip 20. Rotating of the actuation member via the tool 500 in a first direction can cause the actuating member 400 to translate proximally. Rotating the actuation member in a second direction, opposite the first direction, can cause the actuating member 400 to translate distally. The actuating member 400 can include a tapered surface adapted to engage the at least one locking member 310. When the actuating member 400 is rotated in a second direction and translates distally, the tapered surface can engage the at least one locking member 310 and lock the locking system 300 by forcing the at least one locking member 310 outwards in a direction substantially perpendicular to the club axis 90, forcing the locking member 310 to deflect and engage at least one of the plurality of detents 330 formed in the second member 200. In some embodiments, the club length adjustment system can include a torque limiting tool configured to provide the optimal amount of torque in the second direction when locking the locking system 300.

In an alternative embodiment, which is not illustrated, the actuating member 400 can comprise a cam which displaces the locking member 310 through rotation of the actuating member 400 and without translation of the actuation member. The actuating member cam can rotate over center, maintaining the actuating member cam in a locked position until the user rotates the cam back into the unlocked position.

In some embodiments, as illustrated in FIG. 4C, the locking member 310 can be formed integrally to the first member 100 through a machining process. Material can be removed from the first member 100 to produce a beam like structure. In some embodiments, material may be removed from the first member 100 forming a "U" shaped cavity surrounding the locking member 310. In addition, material can be removed from the portion of the locking member 310 furthest from the club axis 90 to provide the desired locking characteristics as well as the desired click discussed above. The protrusion 320 of the locking member 310 can be machined or can be added later via fastening, welding, bonding, etc. In other embodiments, the locking member 310, rather than being constructed integrally with the first member 100, can comprise a moveable member configured to travel substantially perpendicular to the club axis 90 relative to the first member 100 to engage the second member 200 when the user rotates the tool and locks the locking mechanism (not illustrated).

In some embodiments, the club length adjustment device 10 can limit the rotation of the first member 100 relative to the second member 200, and thus rotation of the main shaft 50 and club head relative to the grip 20. The club length adjustment device 10 can incorporate splines to prevent rotation about the club axis 90 but allow for sliding along the club axis 90 between the first member 100 and second member 200. In some embodiments, the first member 100 can include a first spline and the second member 200 can incorporate a complimentary second spline. The first member 100 can be dimensioned to slide within the second member 200 and thus incorporate a male spline 130. The second member 200 can be dimensioned to receive the first member 100 and thus incorporate a female spline 230. Each spline includes complementary spline protrusions and recesses which can slide within one another, but the splines prevent angular rotation between the first member 100 and second member 200.

Most splines allow for a plurality of rotational positions between two members during assembly. In order for the locking system 300 to operate correctly, it can be necessary for the first member 100 and second member 200 to be slideably coupled at a particular angular orientation. In the example of the of the embodiment illustrated in FIG. 3, the first member 100 incorporate two locking members 310 and thus there are two angular orientations at which the first member 100 and second member 200 can be assembled and still function properly, each separated 180 degrees from one another. In order to ensure the first member 100 and second member 200 are assembled at the correct orientation, the first member 100 and second member 200 can each include complementary clocking features. In one embodiment, as illustrated in the figures, the male spline 130 can include at least one enlarged spline protrusion 132 and the female spline 230 can incorporate at least one complementary enlarged spline recess 232 to receive the at least one enlarged spline protrusion 132.

It can be preferable to prevent the first member 100 from being uncoupled from the second member 200 once the club length adjustment device 10 has been assembled. Thus, in some embodiments, the club length adjustment device 10 can include at least one backout prevention member 110. The backout prevention member 110 can limit the first member 100 from sliding out of the second member 200, even when the locking system 300 is unlocked. In some embodiments, the backout prevention member 110 can be formed integrally with the first member 100. The backout prevention member 110 can allow the first member 100 to pass a certain point during assembly, but prevent the first member 100 from travelling back past that point in the opposite direction. In some embodiments, including those illustrated in the figures, the backout prevention member 110 can include a backout protrusion 120. The backout protrusion 120 can include a proximal surface 122 which is ramped and a distal surface 124 which is substantially vertical. At least a portion of the backout prevention member 110 can be deflectable such that when the first member 100 is assembled into the second member 200 the ramped proximal surface 122 engages an enlarged portion of the second member 200, which may include for example, at least one protrusion of the female spline 230, the backout prevention member 110 deflects to allow the first member 100 to slide within the receiving bore 210 of the second member 200 until the backout protrusion 120 clears the enlarged portion and the backout prevention member 110 returns towards its original position. If the first member 100 is pulled distally away from the second member 200, the substantially vertical distal surface 124 will interfere with the enlarged portion of the second member 200, preventing the first member 100 from sliding any further distally. In some embodiments, the proximal surface 122 can be curved to complement the curved inner surface of the second member 200. The second member 200 illustrated in FIGS. 3 and 5 include an access port 220 to allow for the insertion of a tool to deflect the backout prevention member 110 and disassembly of the club length adjustment device 10. The access port 220 is not necessarily required for the club length adjustment device 10 to operate.

In some embodiments, as illustrated in FIG. 4C, the backout prevention member 110 can be formed integrally to the first member 100 through a machining process. Material can be removed from the first member 100 to produce a beam like structure. In some embodiments, material may be removed from the first member 100 forming a "U" shaped cavity surrounding the backout prevention member 110. In addition, material can be removed from the backout prevention member 110 to form the backout protrusion 120. In other embodiments, the backout protrusion 120 can be affixed to the backout prevention member 110 via fastening, welding, bonding, etc. In other embodiments, the backout prevention member 110 can be formed separately from the first member 100 and include a resilient member configured to force the backout protrusion 120 in a direction substantially perpendicular to and away from the club axis 90. In some embodiments, the clocking feature on the first member 100 can extend further proximally along the first member 100 than at least a portion of the backout protrusion 120 such that the first member 100 can be clocked at the correct angular orientation relative to the second member 200 prior to the backout protrusion 120 from engaging the second member 200. In other embodiments, the backout protrusion 120 can engage the second member 200 prior to the clocking feature of the first member 100. In other embodiments, the backout prevention member 110 and locking member 310 can be combined, wherein a single member performs the function of both the backout prevention member 110 and locking member 310 described above.

Various portions of the club length adjustment device 10 can be manufactured from a variety of materials which may include for example, titanium, aluminum, steel, plastic, graphite, composites, etc. Various portions of the club length adjustment device 10 can be manufactured using a variety of methods which may include for example, casting, machining, rapid prototyping, laser sintering, laser cutting, etc.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

I claim:

1. A golf club length adjustment device for use in a golf club, comprising:

a first member affixed to a main shaft, said main shaft configured to couple to a golf club head;

a second member slideably coupled to said first member, said second member adapted to couple to a golf club grip, said golf club grip including an internal cavity configured to receive a golf club shaft;

wherein said first member is configured to slide relative to said second member to change the length of said golf club;

wherein said first member and said second member are configured to limit rotation of said first member relative to said second member;

a locking system configured to selectively limit said first member from sliding relative to said second member;

wherein said locking system comprises a locked position and an unlocked position;

wherein said locking system is configured to selectively lock said first member relative to said second member at each of a plurality of discrete golf club lengths;

wherein said locking system comprises at least one locking member and a plurality of detents, wherein said locking member is configured to selectively engage at least one of said plurality of detents;

wherein said locking system is hidden from view inside said golf club;

wherein at least a portion of said at least one locking member is deflectable and, wherein said at least one locking member, when in said unlocked position, is configured to partially engage at least one of said plurality of detents at each of said discrete golf club lengths creating a click;

wherein said at least one locking member, when in said locked position, is configured to fully engage at least one of said plurality of detents and limit said first member from sliding relative to said second member;

an actuating member configured to force said at least one locking member into said locked position, wherein said actuating member comprises a tool receiving portion such that a user can adjust said actuating member; and wherein rotation of said actuating member forces said at least one locking member into said locked position.

2. The golf club length adjustment device of claim 1, wherein said at least one locking member comprises a protrusion configured to engage at least one of said plurality of detents, wherein said protrusion comprises a partial sphere shape.

3. The golf club length adjustment device of claim 1, wherein said plurality of detents are formed in said second member.

4. The golf club length adjustment device of claim 3, wherein said at least one locking member is formed integrally in said first member, wherein said first member comprises an actuating bore comprising an internal thread, wherein said actuating bore is configured to receive said actuating member, wherein said actuating member comprises a complimentary external thread, wherein said actuating member is configured to translate through said actuating bore via rotation of said actuating member.

5. The golf club length adjustment device of claim 4, wherein said actuating member comprises at least one tapered portion configured to engage said at least one locking member and force said locking member into said locked position.

6. The golf club length adjustment device of claim 4, further comprising a backout prevention member configured to limit said first member from uncoupling from said second member after said golf club length adjustment device has been assembled.

7. The golf club length adjustment device of claim 4, wherein said second member comprises a receiving bore, wherein said second member is configured to receive at least a portion of said first member within said receiving bore of said second member.

8. The golf club length adjustment device of claim 7, wherein said club length adjustment device further comprises a hollow receiving shaft having an interior and an exterior, wherein said second member is affixed to said interior of said receiving shaft, wherein said exterior of said receiving shaft is configured to couple to said golf club grip, wherein said interior of said receiving shaft is configured to slideably receive a portion of said main shaft.

9. The golf club length adjustment device of claim 1, further comprising a length indication system comprising a plurality of marking indicia on said main shaft configured to indicate said length of said golf club.

10. The golf club length adjustment device of claim 1, wherein said first member comprises a first spline and said second member comprises a complimentary second spline, said first spline and said second spline configured to limit rotation of said first member relative to said second member.

11. The golf club length adjustment device of claim 10, wherein said first spline and said second spline comprise complementary clocking features configured to prevent said first member and said second member from being assembled at an incorrect relative angular orientation.

12. The golf club length adjustment device of claim 11, wherein said clocking features comprise at least one enlarged spline recess and at least one enlarged spline protrusion.

13. A golf club length adjustment device for use in a golf club, comprising:

a first member affixed to a main shaft, said main shaft configured to couple to a golf club head;

a second member slideably coupled to said first member, said second member adapted to couple to a golf club grip, said golf club grip including an internal cavity configured to receive a golf club shaft;

wherein said first member is configured to slide relative to said second member to change the length of said golf club;

wherein said first member and said second member are configured to limit rotation of said first member relative to said second member;

a locking system configured to selectively limit said first member from sliding relative to said second member;

wherein said locking system comprises a locked position and an unlocked position;

wherein said locking system is configured to selectively lock said first member relative to said second member at each of a plurality of discrete golf club lengths;

wherein said locking system comprises at least one locking member and a plurality of detents, wherein said locking member is configured to selectively engage at least one of said plurality of detents;

wherein said locking system is hidden from view inside said golf club;

wherein at least a portion of said at least one locking member is deflectable and, wherein said at least one locking member, when in said unlocked position, is configured to partially engage at least one of said plurality of detents at each of said discrete golf club lengths creating a click;

wherein said at least one locking member, when in said locked position, is configured to fully engage at least one of said plurality of detents and limit said first member from sliding relative to said second member;

an actuating member configured to force said at least one locking member into said locked position, wherein said actuating member comprises a tool receiving portion such that a user can adjust said actuating member; and wherein said tool receiving portion of said actuating member is configured to receive a tool inserted through an access hole formed in a proximal portion of said golf club grip, wherein said golf club grip comprises a standard commercially available golf club grip.

* * * * *